US009850041B2

(12) United States Patent
Arch et al.

(10) Patent No.: US 9,850,041 B2
(45) Date of Patent: Dec. 26, 2017

(54) SELF SEALING BAG IN BOX CAP ASSEMBLY

(71) Applicants: James J. Arch, Berkley, IL (US); Charles Thurman, Northlake, IL (US)

(72) Inventors: James J. Arch, Berkley, IL (US); Charles Thurman, Northlake, IL (US)

(73) Assignee: Scholle IPN Corporation, Northlake, IL (US)

( * ) Notice: Subject to any disclaimer, the term of this patent is extended or adjusted under 35 U.S.C. 154(b) by 0 days.

(21) Appl. No.: 14/797,567

(22) Filed: Jul. 13, 2015

(65) Prior Publication Data

US 2016/0009457 A1 Jan. 14, 2016

Related U.S. Application Data

(63) Continuation of application No. 13/902,925, filed on May 27, 2013, now Pat. No. 9,079,694, and a continuation of application No. 12/589,368, filed on Oct. 22, 2009, now Pat. No. 8,448,799.

(60) Provisional application No. 61/196,969, filed on Oct. 22, 2008.

(51) Int. Cl.

| | |
|---|---|
| ***B65D 75/58*** | (2006.01) |
| ***B65D 53/02*** | (2006.01) |
| ***B65D 41/20*** | (2006.01) |
| ***B65D 47/20*** | (2006.01) |
| ***B65D 39/00*** | (2006.01) |
| ***B65D 41/00*** | (2006.01) |
| ***B65D 43/00*** | (2006.01) |
| ***B65D 47/00*** | (2006.01) |

(Continued)

(52) U.S. Cl.

CPC ..... *B65D 41/205* (2013.01); *B65D 47/0838* (2013.01); *B65D 53/02* (2013.01); *B65D 75/5877* (2013.01); *B65D 2231/022* (2013.01)

(58) Field of Classification Search

CPC ..... B65D 41/20; B65D 41/205; B65D 53/02; B65D 75/5877; B65D 2231/022; B65D 47/2025; B65D 47/2031

USPC ..... 215/253

See application file for complete search history.

(56) References Cited

U.S. PATENT DOCUMENTS 5,531,363 A * 7/1996 Gross ..... B65D 47/2031 222/494

5,676,289 A * 10/1997 Gross ..... B65D 47/2031 222/212

(Continued)

*Primary Examiner* — Andrew T Kirsch

(74) *Attorney, Agent, or Firm* — The Watson I.P. Group, PLC; Jovan N. Jovanovic; Vladan M. Vasiljevic

(57) ABSTRACT

A cap assembly comprising a body, a sealing membrane and a retaining ring. An opening is provided through the body and includes a recessed circumferential channel and a membrane engaging flange positioned proximate the recessed circumferential channel. The sealing membrane covers the opening and includes a body engaging flange and a pierceable surface. The retaining ring is positioned with the sealing membrane engagement surface in overlying engagement with the sealing membrane. Extension of the tab into the recessed circumferential channel of the body releasably maintains the overlying engagement and biases the retaining ring against the membrane. The inner wall structure of the retaining ring extends radially inward beyond the membrane engaging flange of the sealing membrane, to, in turn, protect the membrane.

5 Claims, 4 Drawing Sheets

(51) Int. Cl.
*B65D 53/00* (2006.01)
*B65D 47/08* (2006.01)

(56) References Cited

U.S. PATENT DOCUMENTS

| | | | | |
|---|---|---|---|---|
| 2009/0188950 | A1* | 7/2009 | Gaus | B65D 47/2031 222/494 |
| 2009/0212078 | A1* | 8/2009 | Gaus | B65D 47/2031 222/490 |

* cited by examiner

SELF SEALING BAG IN BOX CAP ASSEMBLY

CROSS-REFERENCE TO RELATED APPLICATION

This is a continuation of U.S. patent application Ser. No. 13/902,925 filed May 27, 2013, entitled "Self Sealing Bag In Box Cap Assembly" which is a continuation of U.S. patent application Ser. No. 12/589,368 filed Oct. 22, 2009, entitled "Self Sealing Bag in Box Cap Assembly," which claims priority from U.S. Pat. App. Ser. No. 61/196,969, filed Oct. 22, 2008, entitled "Self Sealing Bag in Box Cap Assembly", the entire disclosure of each of which is hereby incorporated by reference.

BACKGROUND OF THE DISCLOSURE

1. Field of the Disclosure

The disclosure relates in general to a cap assembly, and more particularly, to a self sealing bag in box cap assembly. Such a cap assembly is used in association with the dispensing of flowable material from a bag.

2. Background Art

Self sealing bags have become increasingly useful, especially in the food packaging industry. One current system utilizes a flexible bag having a spout to which a Sentry cap available from Scholle Corporation is affixed. A separate hose is provided which has at a first end a probe and at a second end a connector available from Erie Plastics with a flexible membrane. One such membrane is available from LMS of Illinois. The probe is inserted into the opening of the Sentry cap and the other end is affixed to a distribution hose so that flowable material can be withdrawn from the flexible bag through the Sentry Cap and to the distribution hose. One such system is shown in FIG. 1 referred to generally as 100. Several different embodiments of such a cap are shown in U.S. Pat. No. 7,387,220 issued to Verespej et al and assigned to Scholle Corporation and U.S. Pat. No. 7,357,277 issued to Verespej et al and assigned to Scholle Corporation. Both of these patents are incorporated by reference herein, in their entirety.

Among other drawbacks, such a system requires many separate components which increase the cost of use of such a system. Additionally, with such a system, many connections are utilized, each of which is susceptible to failure.

It is an object of the present invention to provide an improved self sealing bag in box system with an improved cap assembly.

These objects as well as other objects of the present invention will become apparent in light of the present specification, claims, and drawings.

SUMMARY OF THE DISCLOSURE

The disclosure is directed to a cap assembly wherein the cap assembly comprises a body, a sealing membrane and a retaining ring. The body includes a top surface, a bottom surface. A spout engagement channel is positioned on the bottom surface. An opening is provided through the body and includes a recessed circumferential channel and a membrane engaging flange positioned proximate the recessed circumferential channel.

The sealing membrane covers the opening and includes a body engaging flange and a pierceable surface. The sealing membrane is positioned upon the membrane engaging flange so that the body engaging flange and the membrane engaging flange are in overlying engagement.

The retaining ring includes a tab, a sealing membrane engagement surface and an inner wall structure opposite the sealing membrane engagement surface. The retaining ring is positioned with the sealing membrane engagement surface in overlying engagement with the sealing membrane. Extension of the tab into the recessed circumferential channel of the body releasably maintains said overlying engagement and biases the retaining ring against the membrane. The inner wall structure of the retaining ring extends radially inward beyond the membrane engaging flange of the sealing membrane, to in turn, protect the membrane.

In a preferred embodiment, the cap assembly further includes a cap which is removably coupled to the body. The cap is configured to preclude access to the opening and the sealing membrane when the cap assembly is in operable engagement with a bag.

In another preferred embodiment, the inner wall structure of the retaining ring includes an inwardly sloped surface.

In yet another preferred embodiment, the inwardly sloped surface is inclined at an acute angle.

Preferably, the recessed circumferential groove is spaced apart from a top surface of the cap.

In a preferred embodiment, the opening further includes an upper inwardly sloping wall portion positioned above the recessed circumferential channel. In certain embodiments, a lower inwardly sloping wall portion can be positioned below the membrane.

BRIEF DESCRIPTION OF THE DRAWINGS

The disclosure will now be described with reference to the drawings wherein.

DETAILED DESCRIPTION OF THE DISCLOSURE

Figure 1:
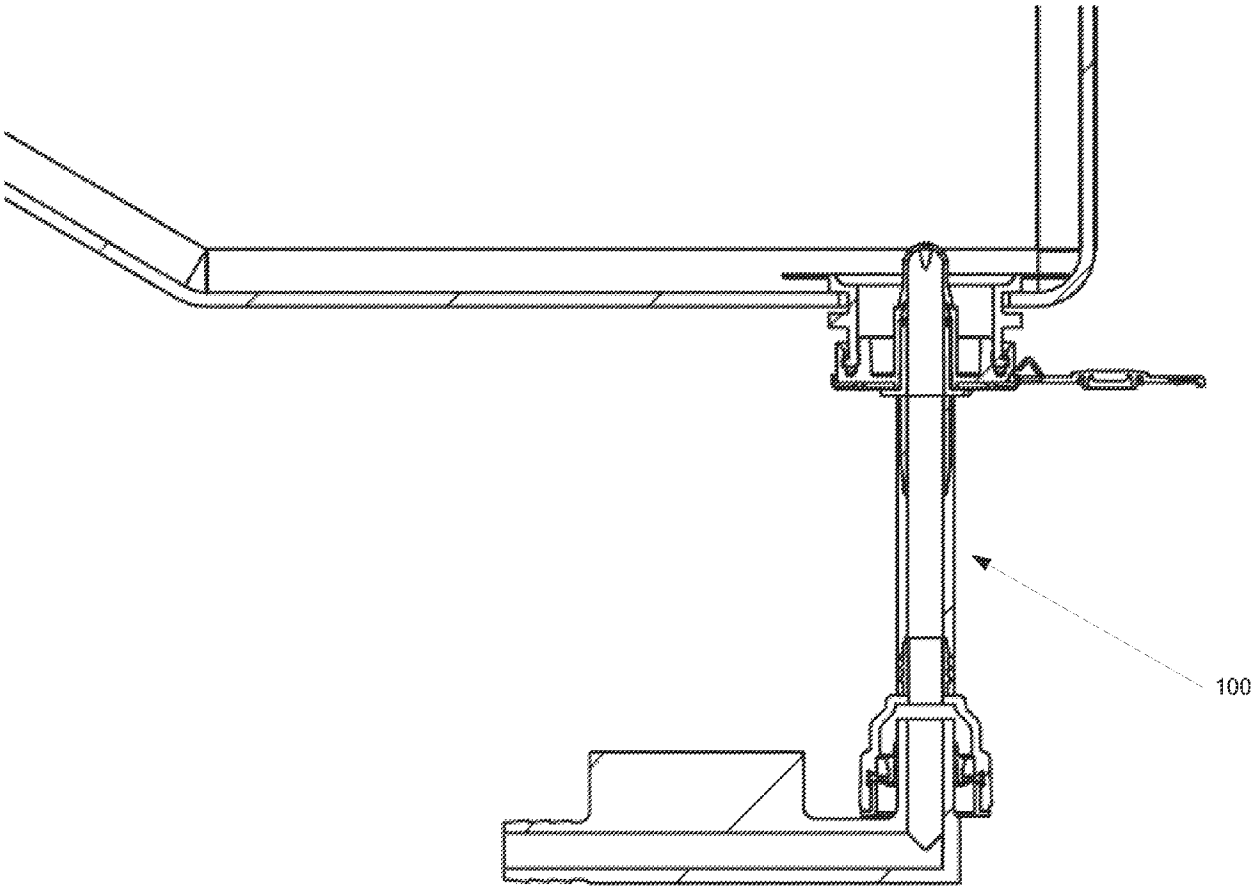
Figure 1 Prior Art
FIG. 1 of the drawings is a prior art system.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 2:
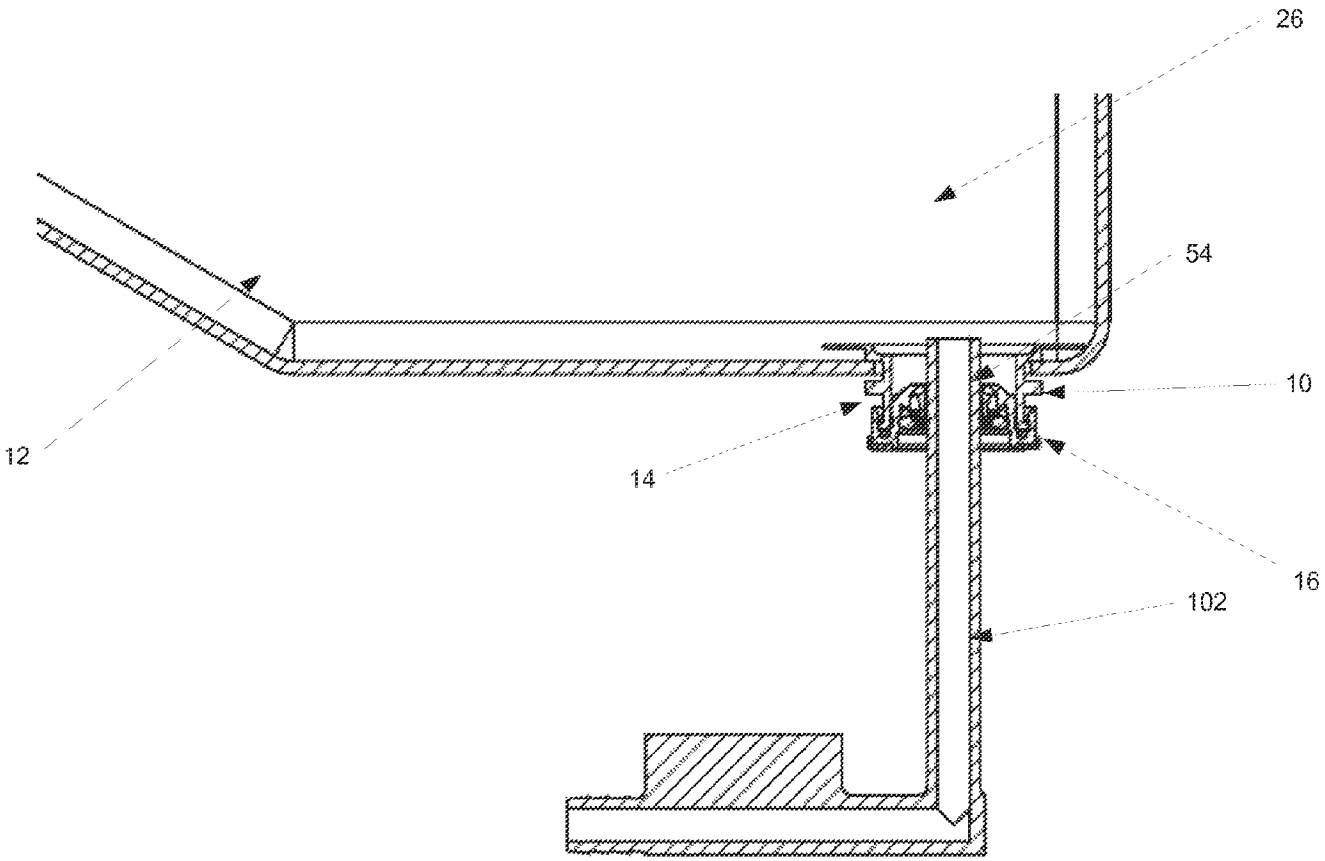
FIG. 2 of the drawings is a system of dispensing utilizing the self sealing bag in box cap assembly.

Referring now to the Figures, and in particular to FIG. 2, container assembly 10 includes container body 12, spout 14 and cap assembly 16. Container body 12 comprises a plurality of panels and a plurality of seals. The panels and seals cooperate to define cavity 26. Of course, the invention is not limited to any particular number of panels and/or seals, or, a container body having any particular geometric configuration. For example, the container body may comprise a pillow-type container, or may comprise a gusseted container, among others.

An exemplary spout 14 is shown in FIG. 2 as comprising a body, base flange, and grasping flanges. The base flange extends from the body. The base flange is larger than the opening on the bag, such that the panel surrounding the opening is welded to the base flange, providing a substantially fluid tight connection. The grasping flanges comprise a number of flanges which are configured for grasping and retaining of the fitment by filling equipment, and for retention by other containers in which the container assembly is positioned (i.e., retention of a box of a bag in box container assembly). The fitment may comprise a HDPE material, or a polypropylene material, among others.

Figure 3:
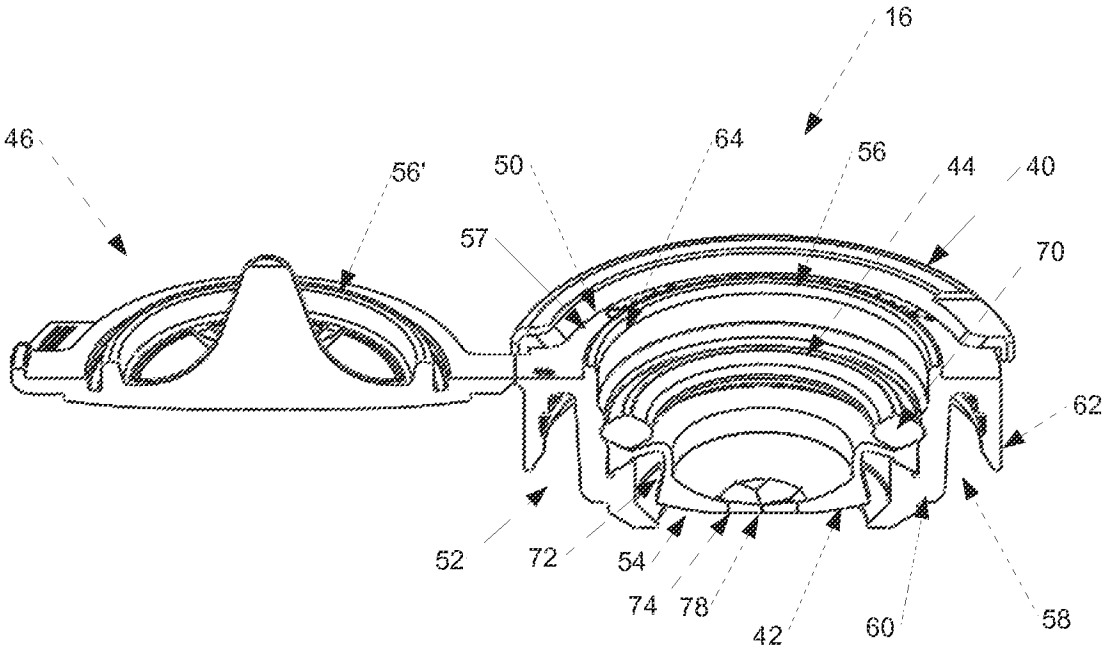
FIG. 3 of the drawings is a perspective cross-sectional view of the self sealing bag in box cap assembly.
Figure 4:
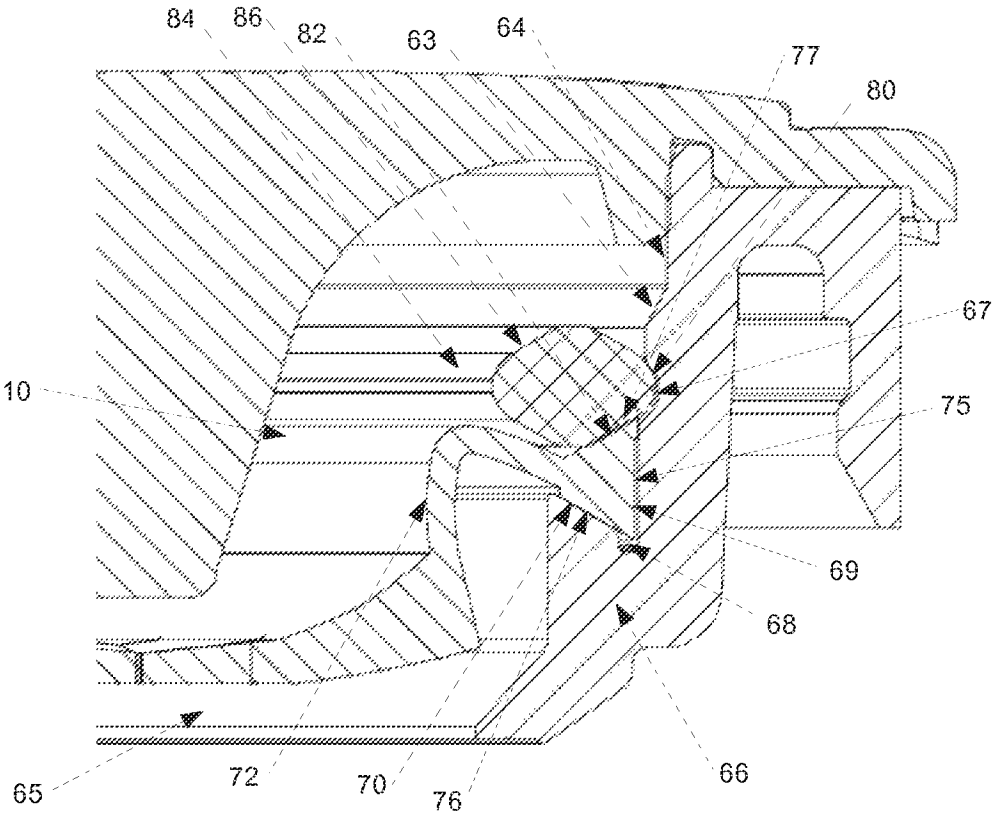
FIG. 4 of the drawings is a partial perspective cross-sectional view of the self sealing bag in box cap assembly.

An exemplary cap assembly 16 is shown in each of FIGS. 3 and/or 4 as comprising base 40, sealing membrane 42, retaining ring 44 and cap/seal 46. The body 40 includes top surface 50, bottom surface 52 and opening 54. Generally, the body and the cap may be integrally molded (much like the Sentry product sold by Scholle Corporation). The sealing membrane and the retaining ring comprise separate elements which are coupled to the base. In certain embodiments, the cap may be omitted, and a membrane seal (formed from a foil or a polymer film) can be sealingly engaged with the top surface 50 of the body. This membrane is frangible and pierced prior to or simultaneous with insertion of a drain or probe into the opening 54 of the cap assembly.

The top surface includes circumferential cap sealing flange 56. The circumferential cap sealing flange 56 is typically employed when cap 46 is utilized. The cap 46 includes a similar sealing flange 56' which together with the cap sealing flange 56 provides a hermetic seal when engaged. In embodiments wherein a membrane seal is utilized, the sealing flange 56 can be omitted, and the membrane seal can be sealed against the circumferential sealing surface 57 which is outboard of the location of the cap sealing flange.

The bottom surface 52 of the body 40 further includes spout engagement channel 58 which is configured to engage and retain a spout, such as spout 14 of the container 10. Generally, the seal is hermetic and results from the elastic deformation of each of the spout and the channel 58. The channel 58 is defined by inner circumferential flange 60 and outer circumferential flange 62 which are concentrically positioned with respect to the opening and with respect to each other. It will be understood that in many embodiments, the inner circumferential flange 60 forms the outer wall of the opening 54. In other embodiments, the outer wall of the opening may comprise a separate structure that is spaced apart from (but preferably concentric with) the circumferential flanges 60, 62.

Opening 54 is shown in FIGS. 3 and/or 4 as comprising inner surface 64 and membrane engaging flange 66 positioned at the lower end thereof. The inner surface 64 includes a recessed circumferential channel 67, a base channel 68 and a membrane engaging surface between the recessed circumferential channel 67 and the base channel 68. In the embodiment shown, the membrane engaging flange 66 is angled so that the surface of the flange is at an acute angle with the membrane engagement surface 69. Of course, this is exemplary and not to be deemed limiting. Additionally, an inwardly sloping guide wall portion 63 may be circumferentially disposed above the recessed circumferential channel so as to direct a probe inwardly toward the membrane above the position of the retaining ring when the retaining ring is in its operable position. Similarly, an upper inwardly sloping lower guide wall portion 65 directs the membrane, and in turn, the probe toward the center of the opening. It has been found that such a portion 65 greatly limits damage to the membrane caused by the probe entering in a less than ideal location.

The sealing membrane 42 is shown in FIGS. 3 and/or 4 as comprising body engagement flange 70, side wall 72 and pierceable surface 74. The body engagement flange 70 comprises a substantially triangular cross-sectional configuration having an outer surface 75, a base surface 76 and a ring surface 77. The side wall 72 emanates from a region proximate the intersection of the base surface 76 and the ring surface 77 and extends in a downward direction away from the top surface 50 of the body 40. The pierceable surface 74 extends across the opening so as to substantially mimic the size thereof. The pierceable surface is substantially perpendicular to the side walls and serves to provide selective egress through the opening 54 of the body 40.

In the embodiment shown, the pierceable surface comprises a silicone material which is flexible and which includes a predetermined number of slits extending therethrough. The slits are configured such that when a probe or tube is extended through the opening, and through the pierceable surface, the engagement surfaces of the slits sealingly engage against the outside of the probe or tube. Once removed, the slits re-engage each other to form a seal and to preclude passage of fluid through the opening. In certain embodiments, the pierceable surface may comprise a plurality of specifically positioned and configured slits that interact with each other. In other embodiments, the slits comprise a plurality of partially cut slits that are then torn or "completed" upon insertion of a probe or tube the first time (i.e., scored slits, or partially formed slits).

Retaining ring 44 comprises a hoop-like structure which has body engaging tab 80, sealing membrane engagement surface 82 and inner wall structure 84. The tab 80 is shown as comprising a projection extending outwardly about the outside perimeter of the retaining ring.

The tab 80 is configured to be insertable and restrainable within the recessed channel 67. With the tab inserted within the channel 67, the body engagement flange 70 of the sealing membrane 42 becomes compressed so as to form a fluid-tight seal between the base surface 76 of the sealing membrane 42 and the membrane engagement flange 66 of opening 54. In particular, the ring presses against the membrane so that its base surface presses against the membrane engaging flange and the ring surface 77 engages the seal membrane engagement surface 82. The natural resilience of the sealing membrane allows for the sealed engagement against the ring and the body. Typically, the seal membrane engagement surface includes a surface area which engages a similarly configured surface area on the membrane itself. The surface area of engagement is such that a significant seal can be created therebetween.

The inner wall structure 84 is configured to preclude damage to the membrane proximate the engagement of the membrane with the membrane engagement flange 66. Typically, the bags associated with the present cap assembly, when full, may have a weight of, for example 25 pounds or the like. As such, when dropped onto a probe-type dispenser that is designed to extend through the membrane, damage to the membrane is of heightened concern. It has been found that the potential for damage to the membrane is greatly reduced with the presently configured inner wall structure 84. The inner wall structure 84 includes a inwardly sloping protective flange 86 that extends over a portion of the membrane and extends radially inwardly beyond the inward projection of the membrane engagement flange 66.

In such a configuration, a downwardly projecting probe may hit the inner wall structure 84 which will direct the probe inwardly toward the membrane. As the probe is directed to the membrane, the engagement of the probe with the membrane occurs at a point that is spaced apart from the membrane engagement flange 66 and thus, an additional measure of give is observed. The inwardly sloping angle is configured to slope inwardly at an acute angle of approximately 20° to 50°, however, the invention is not limited thereto.

As set forth in FIG. 2, the cap is attached to the spout. Tube 102 is extended through the opening 54. Unlike that which is shown in FIG. 1, the sealing membrane is combined with the body.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A cap assembly comprising:

a unitary molded body comprising:

a top surface and a bottom surface, an opening between the top surface and the bottom surface, with an inner surface of the body surrounding the opening, a membrane engaging flange formed in the inner surface of the body between the top surface and the bottom surface;

a recessed circumferential channel formed on the inner surface between the membrane engaging flange and the top surface;

a sealing membrane having a perimeter portion and a portion inside the perimeter portion, comprising:

a body engagement flange on the perimeter of the sealing membrane, the body engagement flange comprising an upper ring surface and a lower base surface, a side wall emanating from the body engagement flange and extending away from the top surface and toward a membrane base surface; and the membrane base surface including a pierceable surface inside the perimeter of the sealing membrane, with the pierceable surface being disposed on an opposite side of the body engagement flange from the top surface, and proximate the bottom surface; and a retaining ring separate from the unitary molded body, the retaining ring having an outside perimeter and a lower side, comprising:

a body engaging tab on the outside perimeter of the retaining ring, a sealing membrane engagement surface on the lower side of the retaining ring, and an inner wall structure on an inside perimeter of the retaining ring, the inner wall structure comprising a protective flange that slopes radially inwardly and downwardly away from the top surface, which inner wall structure extends radially inwardly beyond the body engagement flange so as to overlie a portion of the side wall of the sealing membrane, while being spaced apart from the sealing membrane when the pierceable surface is in a closed configuration;

wherein:

the sealing membrane is disposed within the opening such that the lower base surface of the body engagement flange of the sealing membrane engages with the membrane engaging flange of the body; and the retaining ring is disposed within the opening such that the sealing membrane engagement surface of the retaining ring engages with the upper ring surface of the body engagement flange of the membrane, and the body engaging tab of the retaining ring engages with the circumferential channel on the inner surface of the body; and an inner circumferential flange and an outer circumferential flange, both concentric to each other and extending downward away from the top surface of the body, the inner circumferential flange having an outward surface opposite the inner surface of the of the opening of the body and the outer circumferential flange having an inward surface spaced apart from the outward surface of the inner circumferential flange, and both the inward surface of the outer circumferential flange and the outward surface of the inner circumferential flange facing each other, concentric to each other and axially spaced apart from each other so that the inward surface is facing inwardly toward the outward surface, whereby the inward surface and the outward surface form a spout engagement channel therebetween that opens toward the bottom surface and terminates short of the top surface, and which spout engagement channel is substantially cylindrical.

2. The cap assembly of claim 1, the pierceable surface of the sealing membrane comprising:

a slit having sides structurally configured to open when pierced by a probe or tube inserted into the opening and extended through the slit, the sides of the slit sealingly engaging with the probe or tube while it is extended through the slit, and the sides of the slit sealingly engaging with each other when the probe or tube is removed from the slit.

3. The cap assembly of claim 1, the body further comprising:

an upper guide wall formed on the inner surface between the top surface and the recessed circumferential channel, the upper guide wall sloping downward with respect to the top surface and inward with respect to the opening.

4. The cap assembly of claim 1, the body further comprising:

a lower guide wall formed on the inner surface between the membrane engaging flange and the bottom surface, the lower guide wall sloping downward with respect the top surface and inward with respect to the opening.

5. The cap assembly of claim 1, wherein:

the upper surface of the membrane engaging flange slopes upward with respect to the bottom surface and inward with respect to the opening; and the lower base surface of the body engagement flange slopes downward with respect to the bottom surface and outward with respect to the pierceable surface.

* * * * *